US011421685B2

(12) United States Patent
Bayo

(10) Patent No.: US 11,421,685 B2
(45) Date of Patent: Aug. 23, 2022

(54) VANE PUMP WITH IMPROVED SEAL ASSEMBLY FOR CONTROL CHAMBER

(71) Applicant: Stackpole International Engineered Products, Ltd., Ancaster (CA)

(72) Inventor: Tuncay Bayo, Izmir (TR)

(73) Assignee: Stackpole International Engineered Products, Ltd., Ontario (CA)

( * ) Notice: Subject to any disclaimer, the term of this patent is extended or adjusted under 35 U.S.C. 154(b) by 196 days.

(21) Appl. No.: 16/850,718

(22) Filed: Apr. 16, 2020

(65) Prior Publication Data

US 2020/0340478 A1 Oct. 29, 2020

Related U.S. Application Data

(60) Provisional application No. 62/837,302, filed on Apr. 23, 2019.

(51) Int. Cl.
*F04C 15/00* (2006.01)
*F04C 28/22* (2006.01)
(Continued)

(52) U.S. Cl.
CPC ..... *F04C 15/0034* (2013.01); *F01C 19/005* (2013.01); *F04C 2/3442* (2013.01);
(Continued)

(58) Field of Classification Search
CPC .. F01C 19/005; F04C 14/226; F04C 15/0034; F04C 28/22; F16J 15/16
See application file for complete search history.

(56) References Cited

U.S. PATENT DOCUMENTS 3,400,940 A * 9/1968 Hans-Joachim Conrad ..... F16J 15/46 277/345
4,531,893 A 7/1985 Okoh et al.
(Continued)

FOREIGN PATENT DOCUMENTS

CA 2637454 C 8/2007
CA 2647376 A1 11/2007
(Continued)

OTHER PUBLICATIONS

International Preliminary Report on Patentability dated Sep. 28, 2021, issued in corresponding International Patent Application No. PCT/IB2020/053626 (6 pgs.).
(Continued)

*Primary Examiner* — Mary Davis
(74) *Attorney, Agent, or Firm* — Pillsbury Winthrop Shaw Pittman, LLP

(57) ABSTRACT

A vane pump comprises a housing and a control slide. A rotor rotates to draw lubricant into a rotor receiving space of the slide via a housing inlet and discharges the lubricant via an outlet. The control slide moves to change its eccentricity relative to the rotor for increasing and decreasing a pressure differential between the inlet and outlet. The control slide is biased in a displacement increasing direction. The control slide has one or more seals defining a control chamber with housing. The one or more seals includes a seal assembly received in a recess on a control slide outer surface. The seal assembly has a base element in the recess and a bearing element pivotally attached to the base element and bearing against an inner surface of the housing for sealing. The pivotal attachment includes male and female pivotal connectors coupled together.

21 Claims, 5 Drawing Sheets

(51) Int. Cl.
*F01C 19/00* (2006.01)
*F04C 14/22* (2006.01)
*F04C 2/344* (2006.01)

(52) U.S. Cl.
CPC ..... *F04C 14/226* (2013.01); *F04C 15/0003* (2013.01); *F04C 28/22* (2013.01); *F04C 2210/14* (2013.01)

(56) References Cited

U.S. PATENT DOCUMENTS

| | | | |
|---|---|---|---|
| 8,579,598 | B2 | 11/2013 | Konishi et al. |
| 9,534,598 | B2 | 1/2017 | Mauser et al. |
| 9,556,867 | B2 | 1/2017 | Saga et al. |
| 9,670,925 | B2 | 6/2017 | Watanabe et al. |
| 9,759,215 | B2 | 9/2017 | Kawabata et al. |
| 10,975,699 | B2 | 4/2021 | Meinig et al. |
| 2013/0092476 | A1 | 4/2013 | Fiorini et al. |
| 2014/0199197 | A1 | 7/2014 | Bowing et al. |
| 2017/0058893 | A1 | 3/2017 | Shinohara et al. |
| 2017/0314555 | A1 | 11/2017 | Imanaga |
| 2017/0328365 | A1 | 11/2017 | Lo Biundo et al. |
| 2018/0023564 | A1 | 1/2018 | Naganuma |
| 2018/0058616 | A1 | 3/2018 | Rowley et al. |

FOREIGN PATENT DOCUMENTS

| | | | | |
|---|---|---|---|---|
| CA | 2851317 | A1 | 4/2013 | |
| FR | 2592453 | A1 * | 7/1987 | ..... F16J 15/54 |
| JP | 2009-216070 | A | 9/2009 | |

OTHER PUBLICATIONS

International Search Report and Written Opinion of the International Searching Authority dated Jun. 19, 2020 issued in corresponding International Application No. PCT/IB2020/053626 (8 pgs.).

* cited by examiner

VANE PUMP WITH IMPROVED SEAL ASSEMBLY FOR CONTROL CHAMBER

CROSS-REFERENCE TO RELATED APPLICATIONS

This application claims priority to U.S. Provisional Patent Application No. 62/837,302, filed Apr. 23, 2019, which is hereby incorporated by reference herein in its entirety.

FIELD OF THE INVENTION

The present application relates to a vane pump, and particularly a vane pump with an improved seal assembly for sealing a control chamber.

BACKGROUND

FIG. 2 shows a seal assembly 100 used in prior art vane pumps. The seal assembly has a bearing element 102 slidably engaged with the pump housing interior surface, and a base member 104 supporting it. The seal assembly 100 is mounted in a recess 48 formed on a part of the control slide 18, which are discussed below.

The inventor have recognized that the prior seal assembly 100 has the disadvantage of the two parts 102, 104 not being positionally located to one another. This allows the base member 104 to shift in the slide seal groove 48 and not be centered with the bearing element 102. That causes uneven pressure on the bearing element 102, and therefor uneven contact of the bearing element 102 on the inside surface of the pump housing.

SUMMARY OF THE INVENTION

The present application provides a vane pump comprising: a housing having an inlet and an outlet, and a control slide having a rotor receiving space communicated to the inlet and the outlet. The control slide is mounted in the housing for pivotal movement in opposing displacement increasing and displacement decreasing directions. A rotor comprises a plurality of vanes. The rotor is mounted to the housing and positioned within the rotor receiving space of the control slide. The rotor rotates in the rotor receiving space to draw lubricant under negative pressure into the rotor receiving space via the inlet and discharge the lubricant from the rotor receiving space via the outlet under positive pressure. Movement of the control slide in the displacement increasing direction increases eccentricity between the rotor and the control slide for increasing a pressure differential between the inlet and outlet, and movement of the control slide in the displacement decreasing direction decreases the eccentricity for decreasing the pressure differential. A resilient structure is positioned between the housing and the control slide to bias the control slide in the displacement increasing direction.

The control slide has one or more seals defining a control chamber between the control slide and the housing. The control chamber is communicated with a source of the pressurized lubricant to move the control slide in the displacement decreasing direction.

The one or more seals includes a seal assembly received in a recess formed in an outer surface of the control slide. The seal assembly has a base element received in the recess and a bearing element pivotally attached to the base element and bearing against an inner surface of the housing to provide sealing for the control chamber as the control slide moves in the displacement increasing and decreasing directions. One of the base element and the bearing element has a male pivotal connector and the other of the base element and the bearing element has a female pivotal connector. The male and the female pivotal connectors are coupled together.

Other aspects, features and advantages of the present application will become apparent from the following detailed description, the accompanying drawings, and the appended claims.

DETAILED DESCRIPTION OF THE ILLUSTRATED EMBODIMENT(S)

Figure 1:
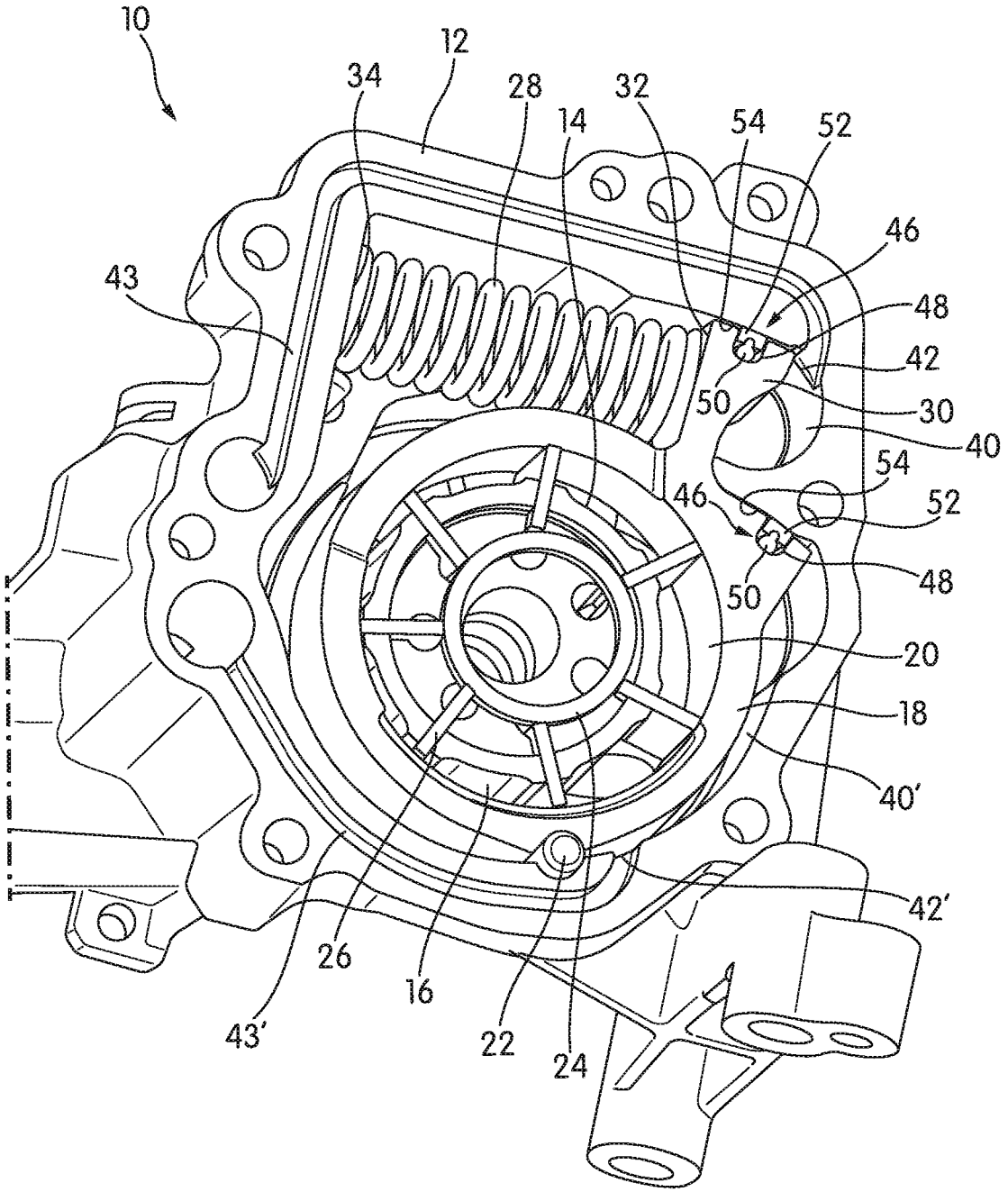
FIG. 1 shows an example embodiment of a vane pump with the cover removed to expose the inner workings thereof.
Figure 2:
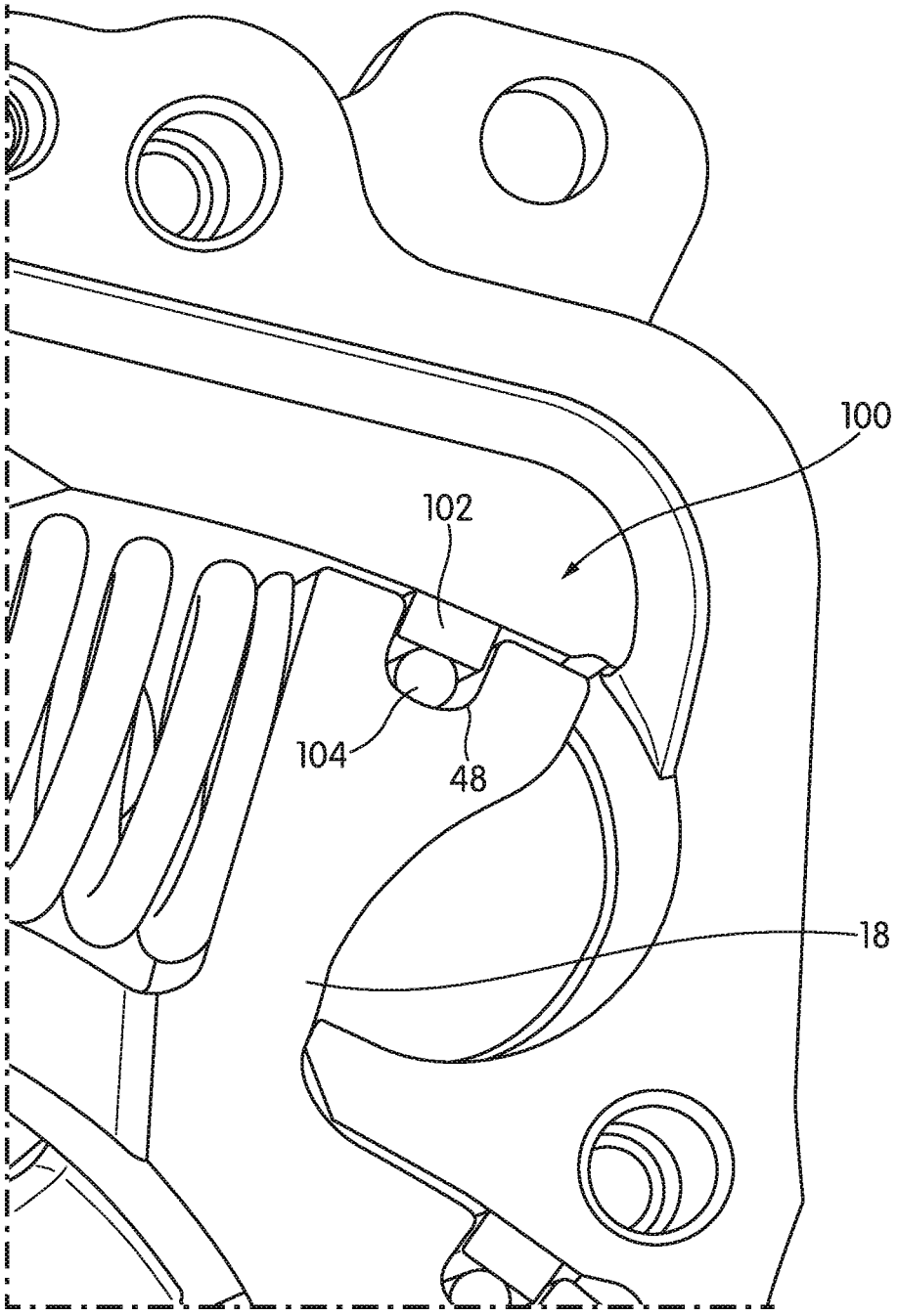
FIG. 2 (PRIOR ART)
FIG. 2 is a close-up of a seal assembly used in prior art pumps.
Figure 3:
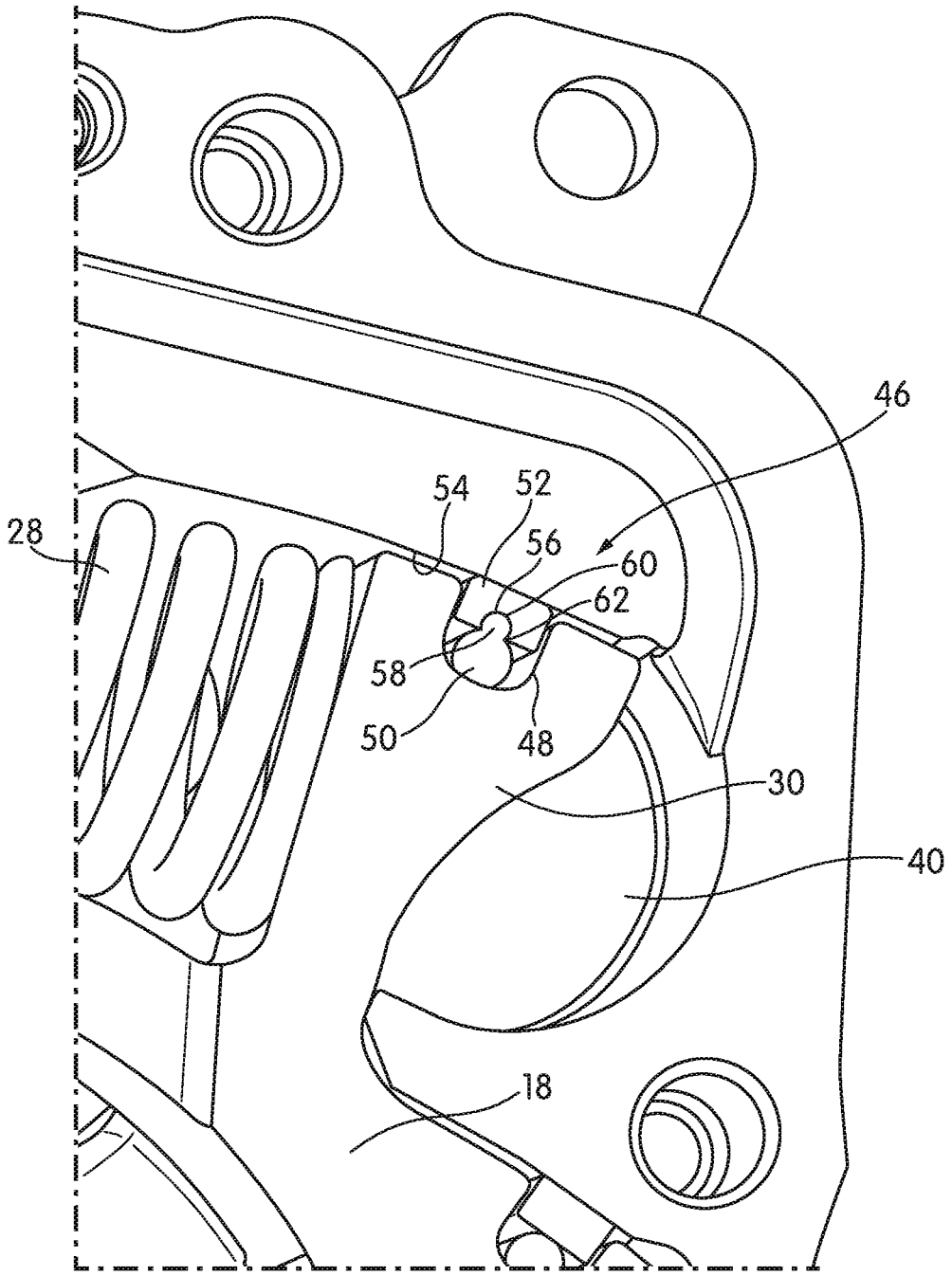
FIG. 3 is a close-up of a seal assembly embodiment of the present invention.
Figure 4:
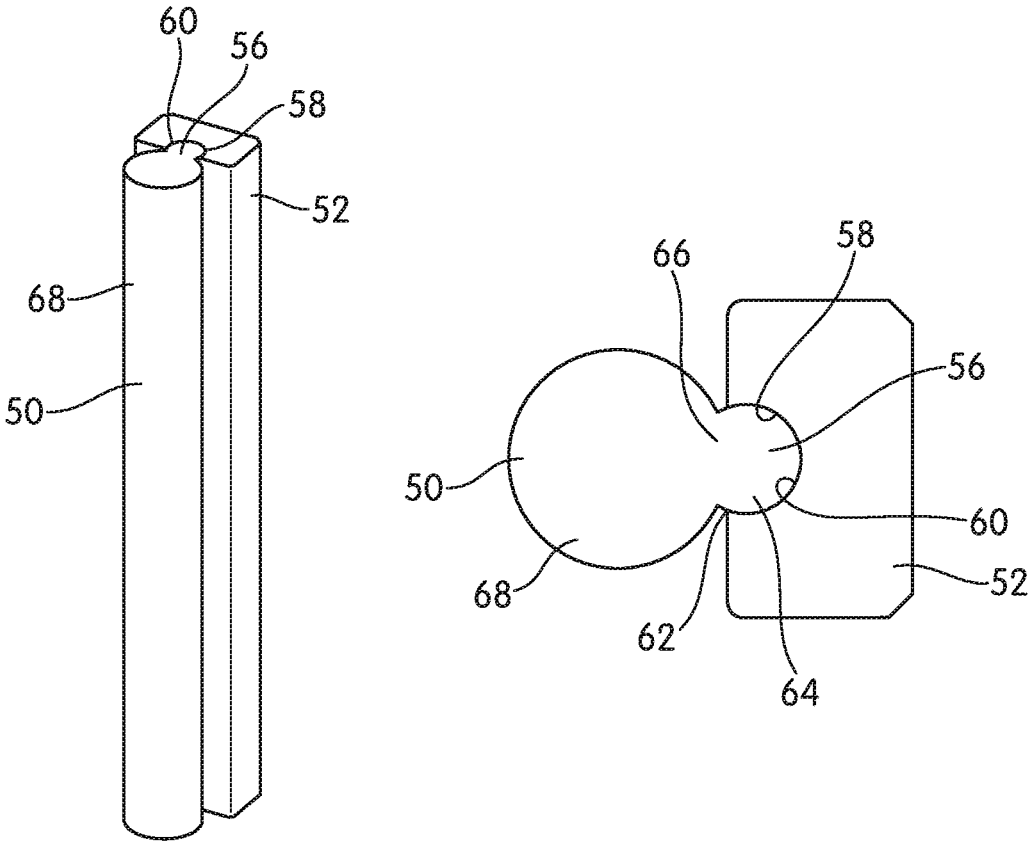
FIG. 4 is a perspective view of the seal assembly in FIG. 3, along with an end view thereof.

The present application provides a vane pump 10 comprising a housing 12 having an inlet 14 and an outlet 16. The housing may have any construction or configuration, and the illustrated embodiment thereof is not intended to be limiting. The inlet 14 and outlet 16 may be connected to any device requiring active pumping of a lubricant, including but not limited to vehicle engines, transmissions, and other mechanical devices.

The inlet 14 generally draws the lubricant in under negative pressure from a source, such as a lubricant sump (e.g., an oil sump) or from generally within an enclosed space (e.g., from within a transmission housing). The outlet 16 generally expels the lubricant under positive pressure to the device requiring lubrication, such as to the oil gallery of an engine. The positive and negative pressures mentioned may be relative to one another, or also relative to ambient atmospheric pressure, depending on the system. The inlet 14 and outlet 16 may each be of single or multi-port design and may have more complex configurations than illustrated depending on the system requirements and are well-known in the art. The housing 12 will often have channels running from the inlet 14 and outlet 16 to inlet and outlet housing ports (not shown) on the housing exterior for connection to other elements within the overall system. The housing 12 may also include other features, such as pressure relief valves and the like, that are not related to the invention discussed herein.

The pump 10 also includes a control slide 18 having a rotor receiving space 20 communicated to the inlet 14 and the outlet 16. The control slide 18 is mounted in the housing 12 for pivotal movement in opposing displacement increasing and displacement decreasing directions. As illustrated, the control slide 18 has a pivotal connection established by a pivot pin 22. The control slide 18 pivots about that pivotal connection/pin 22 in the displacement increasing and displacement decreasing directions. The rotor receiving space 20 may be an essentially cylindrical bore extending through the thickness of the control slide body, as illustrated.

A rotor 24 is mounted to the housing 12 and positioned within the rotor receiving space 20 of the control slide 18. The rotor 24 comprises a plurality of vanes 26. The vanes 26 may be retractable and have springs or other features (e.g., fluid channels) for biasing the vanes 26 radially outwardly for contact with the inner surface of the rotor receiving space 20. The rotor 24 is rotatable in the rotor receiving space 20 (counter-clockwise in the drawings) to draw lubricant under negative pressure into the rotor receiving space 20 via the inlet 14 and discharge the lubricant from the rotor receiving space 20 via the outlet 16 under positive pressure. Movement of the control slide 18 in the displacement increasing direction increases eccentricity between the rotor 20 and the control slide 18 for increasing a pressure differential between the inlet 14 and outlet 16. Conversely, movement of control slide 18 in the opposite displacement decreasing direction decreases that eccentricity for decreasing the pressure differential. The principle of operation creating the pressure differential between the low pressure side of the rotor receiving space 20 (overlapping the inlet 14) and the high pressure side thereof (overlapping the outlet 16) based on the change in volume of the pockets between the individual vanes 26 as regulated by the eccentricity between the control slide 18 and the rotor 20 is well-known and need not be described in detail.

The rotor 24 may be powered in any manner. For example, in engine applications the rotor 24 is often coupled to a gear or pulley driven by a belt or chain, or may be directly driven by another element of the drive train. As another example, the pump may be driven by an electric motor (particularly in electrically powered vehicles) or have two input connections so as to be driven by both an engine driven element or an electric motor (particularly in hybrid vehicles). The manner in which the rotor 24 is driven is not limiting and may occur in any manner.

A resilient structure 28 is positioned between the housing 12 and the control slide 18 to bias the control slide 18 in the displacement increasing direction. In the illustrated embodiment, the resilient structure 28 is a compression spring, but it may have any structure or configuration. For example, fluid pressure devices may act as resilient structures, or other types of springs may be used. The control slide 18 includes a radial projection 30 opposite the pivotal connection, e.g., at pin 22, of the control slide 18 to the housing 20. The radial projection 30 has a surface 32 engaged with the resilient structure 18. In the illustrated embodiment, one end of the spring 28 engages that surface 32, and an opposite end thereof engages against an opposing surface 34 provided in the housing 12. The spring 28 illustrated is held in compression between those surfaces 32, 34, thus applying a reaction force biasing the control slide 18 in the displacement increasing direction.

The control slide 18 has one or more seals, discussed in further detail below, defining a control chamber 40 between the control slide 18 and the housing 12. The control chamber 40 is communicated with a source of the pressurized lubricant to move the control slide 18 in the displacement decreasing direction. In the illustrated embodiment, that pressurized lubricant is fed into the control chamber 40 via a control chamber inlet port 42. The control chamber inlet port 42 may be communicated (directly or indirectly) to the outlet 16 of the housing 12, e.g., via channel 43, and thus the source of pressurized lubricant for the control chamber 40 is the lubricant being discharged from the outlet 16. This is a known feedback approach wherein the pressure from the outlet 16 is used to help regulate the pump's displacement and pressure. As the pressure fed back from the outlet 16 increases, that will result in a pressure increase in the control chamber 40, which in turn moves the control ring 18 in the displacement decreasing direction against the bias of the resilient structure 28 (and that in turn will also decrease the pressure differential generated by vanes 26 and thus the pressure of the lubricant discharged from the outlet 16). Conversely, as the pressure fed back from the outlet 16 decreases, that will result in a pressure decrease in the control chamber 40, which in turn allows the resilient structure to move the control ring 18 in the displacement increasing direction (and that in turn will also increase the pressure differential generated by the rotor 20 and thus the pressure of the lubricant discharged from the outlet 16). This technique may be used to maintain a pump's output pressure and/or volumetric displacement at or near equilibrium levels.

As illustrated, the pump 10 may have multiple control chambers 40, 40' for providing different levels of control over the operation of the pump 10. For example, the pump 10 may also have a second control chamber 40' with inlet port 42' and channel 43' as illustrated, which correspond to elements 40, 42 and 43, respectively. The seal assembly discussed below may be used to seal one or more of those control chambers. Other types of seals may be used for other locations in addition to any seals designed in accordance with the seal assembly discussed below.

Figure 5:
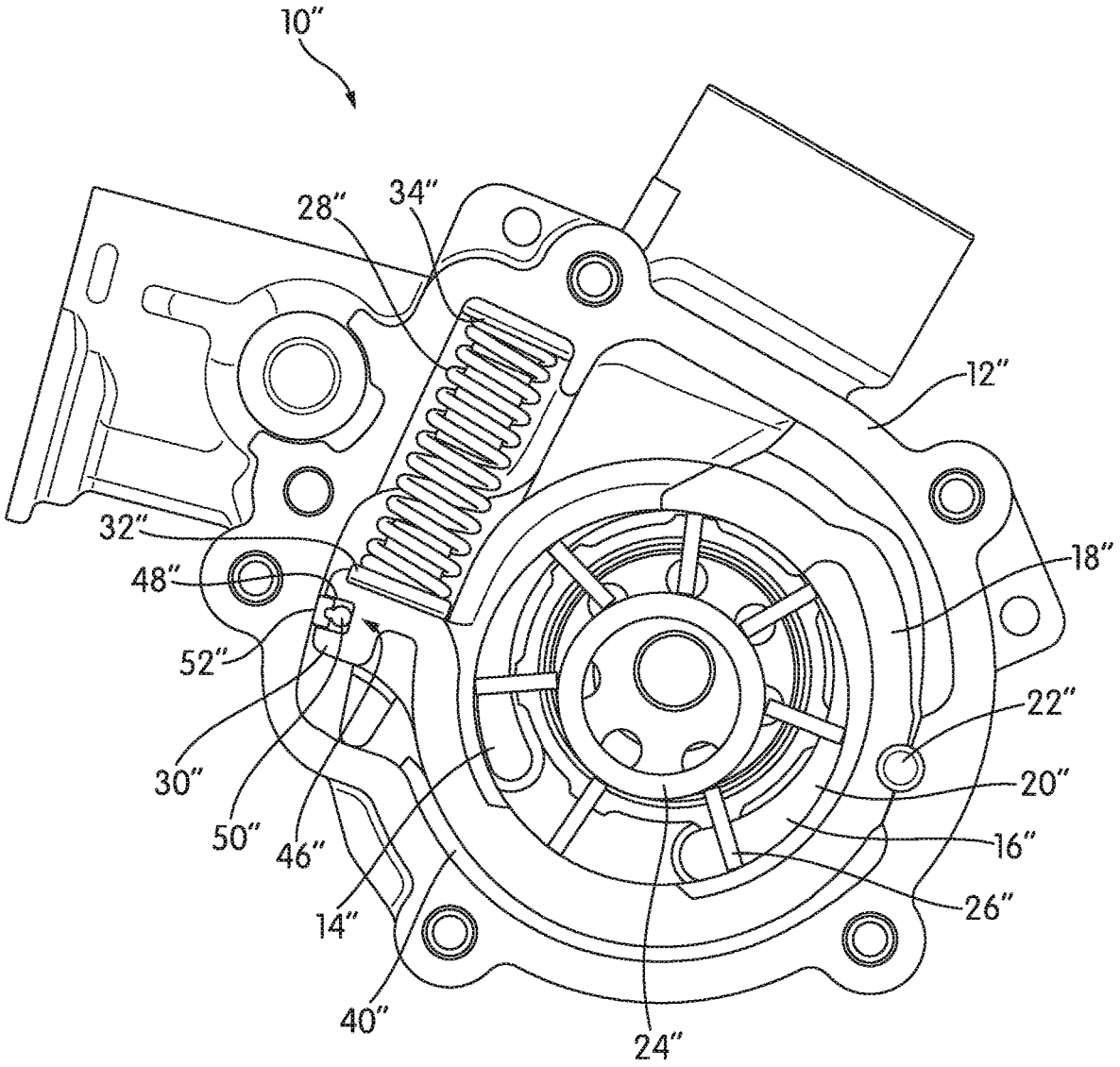
FIG. 5 shows another example embodiment of a vane pump with the cover removed to expose the inner workings thereof.

In other embodiments, such as is shown in FIG. 5, the pump may have only one control chamber. The embodiment of FIG. 5 is structurally similar to the embodiment in FIG. 1, and thus common elements share common reference numbers with a "added to those in FIG. 5. For example, in FIG. 5 the pump is demoted 10", the single control chamber is denoted 40", and so on.

As mentioned, the one or more seals defining the control chamber 40 (or 40' or 40") in the illustrated embodiment includes a seal assembly 46 received in a recess 48 formed in an outer surface of the control slide 18. In the embodiment of FIG. 1, seal assemblies may be used at both ends of the control chamber 40, and the seal assembly 46 may be used for either or both of those seals. As can be seen, a seal assembly 46 is provided at a distal end of control chamber 40 in a recess 48 on an end of the radial projection 30, mentioned above as having the surface 32 engaging the resilient structure 28 and being located distal the pivotal connection at pin 22. Likewise, the control chamber 40 may share at one end a common seal assembly 46 with chamber 40', and the pivotal connection at pivot pin 22 closes off the other, proximal end of that control chamber 40'. (The terms distal and proximal are in reference to the pivotal connection.) In other embodiments, such as illustrated in FIG. 5, the control chamber 40" may be the only control chamber and the seal assembly 46" seals an end of the control chamber 40" distal the pivotal connection at pin 22" of the control slide 18" to the housing 12." The recess 48" receiving the seal assembly 46" is on an end of the radial projection 30", as was the case in FIG. 1. In such an embodiment, the one or more seals is only one seal, which is the seal assembly 46". The opposite/proximal end of the control chamber 40" is closed off by the structure the pivotal connection of the control slide 18, and no seal material is needed.

The seal assembly 46 has a base element 50 received in the recess 48 and a bearing element 52 pivotally attached to the base element 50 and bearing against an inner surface 54 of the housing 12. This provides sealing for the control chamber 40 as the control slide 18 moves in the displacement increasing and decreasing directions. One of the base element 50 and the bearing element 52 has a male pivotal connector 56 and the other of the base element 50 and the bearing element 52 has a female pivotal connector 58. In the illustrated embodiment, the base element 50 of the seal assembly 46 has the male pivotal connector 56 and the bearing element 52 has the female pivotal connector 58. The male and the female pivotal connectors 56, 58 are coupled together to enable pivotal movement of the bearing element 52 as it slides along the housing interior surface 54.

In the illustrated embodiment, the female pivotal connector 58 is defined by bore 60 with a slot 62 narrower than the bore 60. That is, the slot 62 is narrower than the diameter of the bore 62. The male pivotal connector 56 is defined by a head 64 attached by a neck 66 narrower than the head. That is, the neck 66 is the region attaching the head 64 to the remainder of the male pivotal connector 56. In the illustrated embodiment, the bore 60 of the female connector 58 and the head 64 of the male connector 56 are both partially cylindrical, but in other embodiments they may have different configurations. The head 64 is pivotally received in the bore 60 with the neck 66 extending through the slot 62. This establishes the pivotal attachment for enabling pivotal movement of the bearing element 52 as it slides along the housing interior surface 54, as mentioned above.

The pivotal attachment remains centered with respect to the bearing element 52 to promote even contact of the bearing element 52 with the housing interior surface 54. The pivotal attachment also promotes even contact as the bearing element 52 slides along the housing interior surface 54 along its travel path.

The remainder of the base portion 50 has circular, oblong or elliptical shaped portion 68 within the recess 48. That portion 68 may have other shapes or configurations, and the illustrated embodiment is not intended to be limiting. For example, a split-Y shape with two legs may be used. The portion 68, in whatever configuration, is resilient and acts to bias the bearing element 52 against the housing interior surface 54 to promote sealing.

In an embodiment, the bearing element 52 may be formed of any material, such as one with sufficient wear resistance and lower friction for sliding on the housing interior surface. For example, a polymer may be used, such as PTFE (including JTFE), PPS material, or any other material.

The base element 50 may be formed any material, and in one embodiment is an acrylate, such as ACM polkyacrylate. The base element 50 is preferably a resilient material that compresses to provide a biasing force to bias the bearing element 52 against the housing interior surface.

The foregoing embodiments are provided solely to illustrate the structural and functional principles of the present invention and are not intended to be limiting. To the contrary, the present invention encompasses all modification, substitutions, alterations, and equivalents within the spirit and scope of the following claims.

What is claimed is:

1. A vane pump comprising:

a housing having an inlet and an outlet;

a control slide having a rotor receiving space communicated to the inlet and the outlet, the control slide being mounted in the housing for pivotal movement in opposing displacement increasing and displacement decreasing directions;

a rotor comprising a plurality of vanes, the rotor mounted to the housing and positioned within the rotor receiving space of the control slide, the rotor being rotatable in the rotor receiving space to draw lubricant under negative pressure into the rotor receiving space via the inlet and discharge the lubricant from the rotor receiving space via the outlet under positive pressure, wherein movement of the control slide in the displacement increasing direction increases eccentricity between the rotor and the control slide for increasing a pressure differential between the inlet and outlet and movement of the control slide in the displacement decreasing direction decreases the eccentricity for decreasing the pressure differential;

a resilient structure positioned between the housing and the control slide to bias the control slide in the displacement increasing direction;

the control slide having one or more seals defining a control chamber between the control slide and the housing, the control chamber being communicated with a source of pressurized said lubricant to move the control slide in the displacement decreasing direction;

the one or more seals including a seal assembly received in a recess formed in an outer surface of the control slide, the seal assembly having a base element received in the recess and a bearing element pivotally attached to the base element and bearing against an inner surface of the housing to provide sealing for the control chamber as the control slide moves in the displacement increasing and decreasing directions;

wherein one of the base element and the bearing element has a male pivotal connector and the other of the base element and the bearing element has a female pivotal connector, the male and the female pivotal connectors being coupled together, wherein the female pivotal connector is defined by bore with a slot narrower than the bore, and male pivotal connector is defined by a head attached by a neck narrower than the head, the head being pivotally received in the bore with the neck extending through the slot.

2. The vane pump of claim 1, wherein the control slide includes a radial projection opposite a pivotal connection of the control slide to the housing, the radial projection having a surface engaged with the resilient structure.

3. The vane pump of claim 2, wherein the recess receiving the seal assembly is on an end of the radial projection.

4. The vane pump of claim 1, wherein the base element of the seal assembly has the male pivotal connector and the bearing element of the seal assembly has the female pivotal connector.

5. The vane pump of claim 1, wherein the bore of the female connector and the head of the male connector are both partially cylindrical.

6. The vane pump of claim 1, wherein the control chamber is the only control chamber and the seal assembly seals an end of the control chamber distal a pivotal connection of the control slide to the housing.

7. The vane pump of claim 6, wherein the one or more seals is only one seal, which seal is the seal assembly.

8. The vane pump of claim 1, wherein the control chamber includes an inlet port communicated to the outlet of the housing, the source of pressurized said lubricant for the control chamber being the lubricant discharged from the outlet.

9. A vehicle comprising:

a device that receives lubricant:

a lubricant sump for containing a supply of the lubricant; and a vane pump comprising:

a housing having an inlet communicated to the lubricant sump and an outlet communicated to the device;

a control slide having a rotor receiving space communicated to the inlet and the outlet, the control slide being mounted in the housing for pivotal movement in opposing displacement increasing and displacement decreasing directions;

a rotor comprising a plurality of vanes, the rotor mounted to the housing and positioned within the rotor receiving space of the control slide, the rotor being rotatable in the rotor receiving space to draw the lubricant under negative pressure into the rotor receiving space via the inlet and discharge the lubricant from the rotor receiving space via the outlet under positive pressure, wherein movement of the control slide in the displacement increasing direction increases eccentricity between the rotor and the control slide for increasing a pressure differential between the inlet and outlet and movement of the control slide in the displacement decreasing direction decreases the eccentricity for decreasing the pressure differential;

a resilient structure positioned between the housing and the control slide to bias the control slide in the displacement increasing direction;

the control slide having one or more seals defining a control chamber between the control slide and the housing, the control chamber being communicated with a source of pressurized said lubricant to move the control slide in the displacement decreasing direction;

the one or more seals including a seal assembly received in a recess formed in an outer surface of the control slide, the seal assembly having a base element received in the recess and a bearing element pivotally attached to the base element and bearing against an inner surface of the housing to provide sealing for the control chamber as the control slide moves in the displacement increasing and decreasing directions;

wherein one of the base element and the bearing element has a male pivotal connector and the other of the base element and the bearing element has a female pivotal connector, the male and the female pivotal connectors being coupled together, wherein the female pivotal connector is defined by bore with a slot narrower than the bore, and male pivotal connector is defined by a head attached by a neck narrower than the head, the head being pivotally received in the bore with the neck extending through the slot.

10. The vehicle of claim 9, wherein the control slide includes a radial projection opposite a pivotal connection of the control slide to the housing, the radial projection having a surface engaged with the resilient structure.

11. The vehicle of claim 10, wherein the recess receiving the seal assembly is on an end of the radial projection.

12. The vehicle of claim 9, wherein the base element of the seal assembly has the male pivotal connector and the bearing element of the seal assembly has the female pivotal connector.

13. The vehicle of claim 9, wherein the bore of the female connector and the head of the male connector are both partially cylindrical.

14. The vehicle of claim 9, wherein the control chamber is the only control chamber and the seal assembly seals an end of the control chamber distal a pivotal connection of the control slide to the housing.

15. The vehicle of claim 14, wherein the one or more seals is only one seal, which seal is the seal assembly.

16. The vehicle of claim 9, wherein the control chamber includes an inlet port communicated to the outlet of the housing, the source of pressurized said lubricant for the control chamber being the lubricant discharged from the outlet.

17. The vehicle of claim 9, wherein the device is one or more selected from the group consisting of an engine and a transmission.

18. The vehicle of claim 9, wherein the device is an engine.

19. The vehicle of claim 9, wherein the device is a transmission.

20. A vane pump comprising:

a housing having an inlet and an outlet;

a control slide having a rotor receiving space communicated to the inlet and the outlet, the control slide being mounted in the housing for pivotal movement in opposing displacement increasing and displacement decreasing directions;

a rotor comprising a plurality of vanes, the rotor mounted to the housing and positioned within the rotor receiving space of the control slide, the rotor being rotatable in the rotor receiving space to draw lubricant under negative pressure into the rotor receiving space via the inlet and discharge the lubricant from the rotor receiving space via the outlet under positive pressure, wherein movement of the control slide in the displacement increasing direction increases eccentricity between the rotor and the control slide for increasing a pressure differential between the inlet and outlet and movement of the control slide in the displacement decreasing direction decreases the eccentricity for decreasing the pressure differential;

a resilient structure positioned between the housing and the control slide to bias the control slide in the displacement increasing direction;

the control slide having one or more seals defining a control chamber between the control slide and the housing, the control chamber being communicated with a source of pressurized said lubricant to move the control slide in the displacement decreasing direction;

the one or more seals including a seal assembly received in a recess formed in an outer surface of the control slide, the seal assembly having a base element received in the recess and a bearing element pivotally attached to the base element and bearing against an inner surface of the housing to provide sealing for the control chamber as the control slide moves in the displacement increasing and decreasing directions;

wherein one of the base element and the bearing element has a male pivotal connector and the other of the base element and the bearing element has a female pivotal connector, the male and the female pivotal connectors being coupled together, wherein the base element of the seal assembly has the male pivotal connector and the bearing element of the seal assembly has the female pivotal connector, wherein the female pivotal connector is defined by bore with a slot narrower than the bore, and male pivotal connector is defined by a head attached by a neck narrower than the head, the head being pivotally received in the bore with the neck extending through the slot.

21. A vehicle comprising:

a device that receives lubricant:

a lubricant sump for containing a supply of the lubricant; and a vane pump comprising:

a housing having an inlet communicated to the lubricant sump and an outlet communicated to the device;

a control slide having a rotor receiving space communicated to the inlet and the outlet, the control slide being mounted in the housing for pivotal movement in opposing displacement increasing and displacement decreasing directions;

a rotor comprising a plurality of vanes, the rotor mounted to the housing and positioned within the rotor receiving space of the control slide, the rotor being rotatable in the rotor receiving space to draw the lubricant under negative pressure into the rotor receiving space via the inlet and discharge the lubricant from the rotor receiving space via the outlet under positive pressure, wherein movement of the control slide in the displacement increasing direction increases eccentricity between the rotor and the control slide for increasing a pressure differential between the inlet and outlet and movement of the control slide in the displacement decreasing direction decreases the eccentricity for decreasing the pressure differential;

a resilient structure positioned between the housing and the control slide to bias the control slide in the displacement increasing direction;

the control slide having one or more seals defining a control chamber between the control slide and the housing, the control chamber being communicated with a source of pressurized said lubricant to move the control slide in the displacement decreasing direction;

the one or more seals including a seal assembly received in a recess formed in an outer surface of the control slide, the seal assembly having a base element received in the recess and a bearing element pivotally attached to the base element and bearing against an inner surface of the housing to provide sealing for the control chamber as the control slide moves in the displacement increasing and decreasing directions;

wherein one of the base element and the bearing element has a male pivotal connector and the other of the base element and the bearing element has a female pivotal connector, the male and the female pivotal connectors being coupled together, wherein the base element of the seal assembly has the male pivotal connector and the bearing element of the seal assembly has the female pivotal connector, wherein the female pivotal connector is defined by bore with a slot narrower than the bore, and male pivotal connector is defined by a head attached by a neck narrower than the head, the head being pivotally received in the bore with the neck extending through the slot.

* * * * *